US008626515B2

(12) United States Patent
Oh et al.

(10) Patent No.: US 8,626,515 B2
(45) Date of Patent: Jan. 7, 2014

(54) APPARATUS FOR PROCESSING MEDIA SIGNAL AND METHOD THEREOF

(75) Inventors: Hyen O Oh, Gyeonggi-do (KR); Hee Suk Pang, Seoul (KR); Dong Soo Kim, Seoul (KR); Jae Hyun Lim, Seoul (KR); Yang Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 1176 days.

(21) Appl. No.: 12/295,451

(22) PCT Filed: Mar. 30, 2007

(86) PCT No.: PCT/KR2007/001560

§ 371 (c)(1),
(2), (4) Date: Oct. 24, 2008

(87) PCT Pub. No.: WO2007/114594

PCT Pub. Date: Oct. 11, 2007

(65) Prior Publication Data

US 2009/0164227 A1 Jun. 25, 2009

Related U.S. Application Data

(60) Provisional application No. 60/787,516, filed on Mar. 31, 2006, provisional application No. 60/787,172, filed on Mar. 30, 2006.

(51) Int. Cl.
*G10L 19/00* (2013.01)

(52) U.S. Cl.
USPC ..... 704/500

(58) Field of Classification Search
USPC ..... 704/500
See application file for complete search history.

(56) References Cited

U.S. PATENT DOCUMENTS

| | | | |
|---|---|---|---|
| 5,166,685 | A | 11/1992 | Campbell et al. |
| 5,524,054 | A | 6/1996 | Spille et al |
| 5,579,396 | A | 11/1996 | Iida et al. |
| 5,632,005 | A | 5/1997 | Davis et al. |
| 5,703,584 | A | 12/1997 | Hill, et al. |
| 6,118,875 | A | 9/2000 | Møller et al. |
| 6,307,941 | B1 | 10/2001 | Tanner et al. |
| 6,574,339 | B1 | 6/2003 | Kim |

(Continued)

FOREIGN PATENT DOCUMENTS

| | | |
|---|---|---|
| CN | 1669359 | 9/2005 |
| EP | 1455345 | 9/2004 |

(Continued)

OTHER PUBLICATIONS

European Office Action for Application No. 07745723.2 dated Mar. 2, 2010, 9 pages.

(Continued)

*Primary Examiner* — Jakieda Jackson
(74) *Attorney, Agent, or Firm* — Fish & Richardson P.C.

(57) ABSTRACT

The present invention relates to an apparatus for processing a media signal and method thereof. A method of processing a media signal according to the present invention includes extracting a downmix signal from a bitstream, extracting at least one of first spatial information and second spatial information from the bitstream, and generating multi-channels using the extracted spatial information and the downmix signal. And, the present invention provides a decoding method and apparatus for generating various kinds of multi-channels.

13 Claims, 7 Drawing Sheets

(56) References Cited

U.S. PATENT DOCUMENTS

| | | | | |
|---|---|---|---|---|
| 6,711,266 | B1 | 3/2004 | Aylward | |
| 6,973,130 | B1 | 12/2005 | Wee et al. | |
| 7,555,434 | B2 | 6/2009 | Nomura et al. | |
| 7,916,873 | B2 * | 3/2011 | Villemoes et al. | 381/22 |
| 7,974,713 | B2 * | 7/2011 | Disch et al. | 700/94 |
| 8,054,981 | B2 * | 11/2011 | Roden et al. | 381/23 |
| 2003/0236583 | A1 | 12/2003 | Baumgarte et al. | |
| 2004/0071445 | A1 | 4/2004 | Tarnoff et al. | |
| 2004/0196770 | A1 | 10/2004 | Touyama et al. | |
| 2005/0074127 | A1 | 4/2005 | Herre et al. | |
| 2005/0180579 | A1 | 8/2005 | Baumgarte et al. | |
| 2005/0195981 | A1 | 9/2005 | Faller et al. | |
| 2006/0115100 | A1 | 6/2006 | Faller et al. | |
| 2006/0133618 | A1 | 6/2006 | Villemoes et al. | |
| 2006/0153408 | A1 | 7/2006 | Faller et al. | |
| 2007/0055510 | A1 * | 3/2007 | Hilpert et al. | 704/230 |

FOREIGN PATENT DOCUMENTS

| | | |
|---|---|---|
| JP | 09-275544 | 10/1997 |
| JP | 2001-188578 | 7/2001 |
| JP | 2005-533426 | 11/2005 |
| JP | 08-065169 | 3/2008 |
| JP | 08-202397 | 9/2008 |
| KR | 10-2001-0001993 | 1/2001 |
| KR | 10-2001-0009258 | 2/2001 |
| RU | 2119259 | 9/1998 |
| RU | 2129336 | 4/1999 |
| TW | 289885 | 11/1996 |
| TW | 550541 | 9/2003 |
| TW | 200304120 | 9/2003 |
| TW | 200405673 | 4/2004 |
| TW | 594675 | 6/2004 |
| WO | 9949574 | 9/1999 |
| WO | WO 03/007656 | 1/2003 |
| WO | 2003-090208 | 10/2003 |
| WO | 2004-008805 | 1/2004 |
| WO | 2004-019656 | 3/2004 |
| WO | 2004-036549 | 4/2004 |
| WO | 2004-036954 | 4/2004 |
| WO | 2004-036955 | 4/2004 |
| WO | 2004036548 | 4/2004 |
| WO | W02007058510 A1 | 5/2007 |

OTHER PUBLICATIONS

Taiwan Patent Office, Office Action in Taiwanese patent application 096102410, dated Jul. 2, 2009, 5 pages.

Russian Notice of Allowance for Application No. 2008114388, dated Aug. 24, 2009, 13 pages.

Taiwan Examiner, Taiwanese Office Action for Application No. 96104544, dated Oct. 9, 2009, 13 pages.

Breebaart, et al.: "Multi-Channel Goes Mobile: MPEG Surround Binaural Rendering" In: Audio Engineering Society the 29th International Conference, Seoul, Sep. 2-4, 2006, pp. 1-13. See the abstract, pp. 1-4, figures 5,6.

Breebaart, J., et al.: "MPEG Spatial Audio Coding/MPEG Surround: Overview and Current Status" In: Audio Engineering Society the 119th Convention, New York, Oct. 7-10, 2005, pp. 1-17. See pp. 4-6.

Faller, C., et al.: "Binaural Cue Coding-Part II: Schemes and Applications", IEEE Transactions on Speech and Audio Processing, vol. 11, No. 6, 2003, 12 pages.

Faller, C.: "Coding of Spatial Audio Compatible with Different Playback Formats", Audio Engineering Society Convention Paper, Presented at 117th Convention, Oct. 28-31, 2004, San Francisco, CA.

Faller, C.: "Parametric Coding of Spatial Audio", Proc. of the 7th Int. Conference on Digital Audio Effects, Naples, Italy, 2004, 6 pages.

Herre, J., et al.: "Spatial Audio Coding: Next generation efficient and compatible coding of multi-channel audio", Audio Engineering Society Convention Paper, San Francisco, CA , 2004, 13 pages.

Herre, J., et al.: "The Reference Model Architecture for MPEG Spatial Audio Coding", Audio Engineering Society Convention Paper 6447, 2005, Barcelona, Spain, 13 pages.

International Search Report in International Application No. PCT/KR2006/000345, dated Apr. 19, 2007, 1 page.

International Search Report in International Application No. PCT/KR2006/000346, dated Apr. 18, 2007, 1 page.

International Search Report in International Application No. PCT/KR2006/000347, dated Apr. 17, 2007, 1 page.

International Search Report in International Application No. PCT/KR2006/000866, dated Apr. 30, 2007, 1 page.

International Search Report in International Application No. PCT/KR2006/000867, dated Apr. 30, 2007, 1 page.

International Search Report in International Application No. PCT/KR2006/000868, dated Apr. 30, 2007, 1 page.

International Search Report in International Application No. PCT/KR2006/001987, dated Nov. 24, 2006, 2 pages.

International Search Report in International Application No. PCT/KR2006/002016, dated Oct. 16, 2006, 2 pages.

International Search Report in International Application No. PCT/KR2006/003659, dated Jan. 9, 2007, 1 page.

International Search Report in International Application No. PCT/KR2006/003661, dated Jan. 11, 2007, 1 page.

International Search Report in International Application No. PCT/KR2007/000340, dated May 4, 2007, 1 page.

International Search Report in International Application No. PCT/KR2007/000668, dated Jun. 11, 2007, 2 pages.

International Search Report in International Application No. PCT/KR2007/000672, dated Jun. 11, 2007, 1 page.

International Search Report in International Application No. PCT/KR2007/000675, dated Jun. 8, 2007, 1 page.

International Search Report in International Application No. PCT/KR2007/000676, dated Jun. 8, 2007, 1 page.

International Search Report in International Application No. PCT/KR2007/000730, dated Jun. 12, 2007, 1 page.

International Search Report in International Application No. PCT/KR2007/001560, dated Jul. 20, 2007, 1 page.

International Search Report in International Application No. PCT/KR2007/001602, dated Jul. 23, 2007, 1 page.

Scheirer, E. D., et al.: "AudioBIFS: Describing Audio Scenes with the MPEG-4 Multimedia Standard", IEEE Transactions on Multimedia, Sep. 1999, vol. 1, No. 3, pp. 237-250. See the abstract.

Vannanen, R., et al.: "Encoding and Rendering of Perceptual Sound Scenes in the Carrouso Project", AES 22nd International Conference on Virtual, Synthetic and Entertainment Audio, Paris, France, 9 pages.

Vannanen, Riitta, "User Interaction and Authoring of 3D Sound Scenes in the Carrouso EU project", Audio Engineering Society Convention Paper 5764, Amsterdam, The Netherlands, 2003, 9 pages.

Faller and Baumgarte, "Efficient Representation of Spatial Audio using Perceptual Parametrization," *Proceedings of the 2001 IEEE Workshop on the Applications of Signal Processing to Audio and Acoustics*, 2001, 4 pages.

* cited by examiner

APPARATUS FOR PROCESSING MEDIA SIGNAL AND METHOD THEREOF

TECHNICAL FIELD

The present invention relates to an apparatus for processing a media signal and method thereof.

BACKGROUND ART

In the present invention, media signals include an audio signal and a video signal. And, the audio signal is explained as an example in the following description.

Currently, 2-channel signal is most frequently generated and user. Yet, the use of multi-channel signals gradually increases. In the /following description, an audio signal including at least three channels is called a multi-channel signal to be discriminated from the 2-channel signal. In general, an encoder compresses a multi-channel signal into a mono- or stereo-type downmix signal instead of compressing channels of the multi-channel signal individually. A downmixing unit of the encoder extracts spatial information by downmixing multi-channels. The encoder transfers the compressed downmix signal and the spatial information to a decoder or stores them in a storage medium. The spatial information is used in reconstructing an original multi-channel signal from the compressed downmix signal. In case of using an encoder and decoder for 2-channel signal compression and reconstruction, the encoder generates a downmix signal and spatial information from a 2-channel signal and then transfers a bitstream including them to the decoder. The decoder upmixes the transferred bitstream to generate the original 2-channel signal. In case that the encoder and decoder are used for compression and reconstruction of a multi-channel signal, the encoder generates a downmix signal and spatial information from the multi-channel signal and then transfers a bitstream including the downmix signal and spatial information to the decoder. The decoder then upmixes the transferred bitstream to generate the original multi-channel signal.

DISCLOSURE OF THE INVENTION

Technical Objects

Accordingly, the present invention is directed to an apparatus for processing a media signal and method thereof that substantially obviate one or more of the problems due to limitations and disadvantages of the related art.

An object of the present invention is to provide an encoding method and apparatus, by which spatial information for audio signal reconstruction having an audio quality close to an audio signal prior to downmixing can be generated.

Another object of the present invention is to provide an encoding method and apparatus, by which a bitstream including both spatial information used in generating a 2-channel signal and spatial information used in generating a multi-channel signal can be provided and generated.

Another object of the present invention is to provide a decoding method and apparatus, by which a 2-channel signal or a multi-channel signal can be selectively generated.

Technical Solution

The present invention extracts a downmix signal from a bitstream and also extracts at least one of first spatial information and second spatial information from the bitstream.

And, the present invention provides a method and apparatus for generating specific multi-channels using the extracted spatial information and the extracted downmix signal.

Advantageous Effects

The present invention can provide an encoding method and apparatus for generating spatial information to reconstruct an audio signal having an audio quality close to a former audio signal prior to downmixing.

The present invention can provide a bitstream including both spatial information used in generating a 2-channel signal and spatial information used in generating a multi-channel signal. And, the present invention can provide an encoding method and apparatus for generating the bitstream.

And, the present invention can provide a decoding method and apparatus capable of generating a 2-channel signal or a multi-channel signal selectively.

BEST MODE FOR CARRYING OUT THE INVENTION

Figure 1:
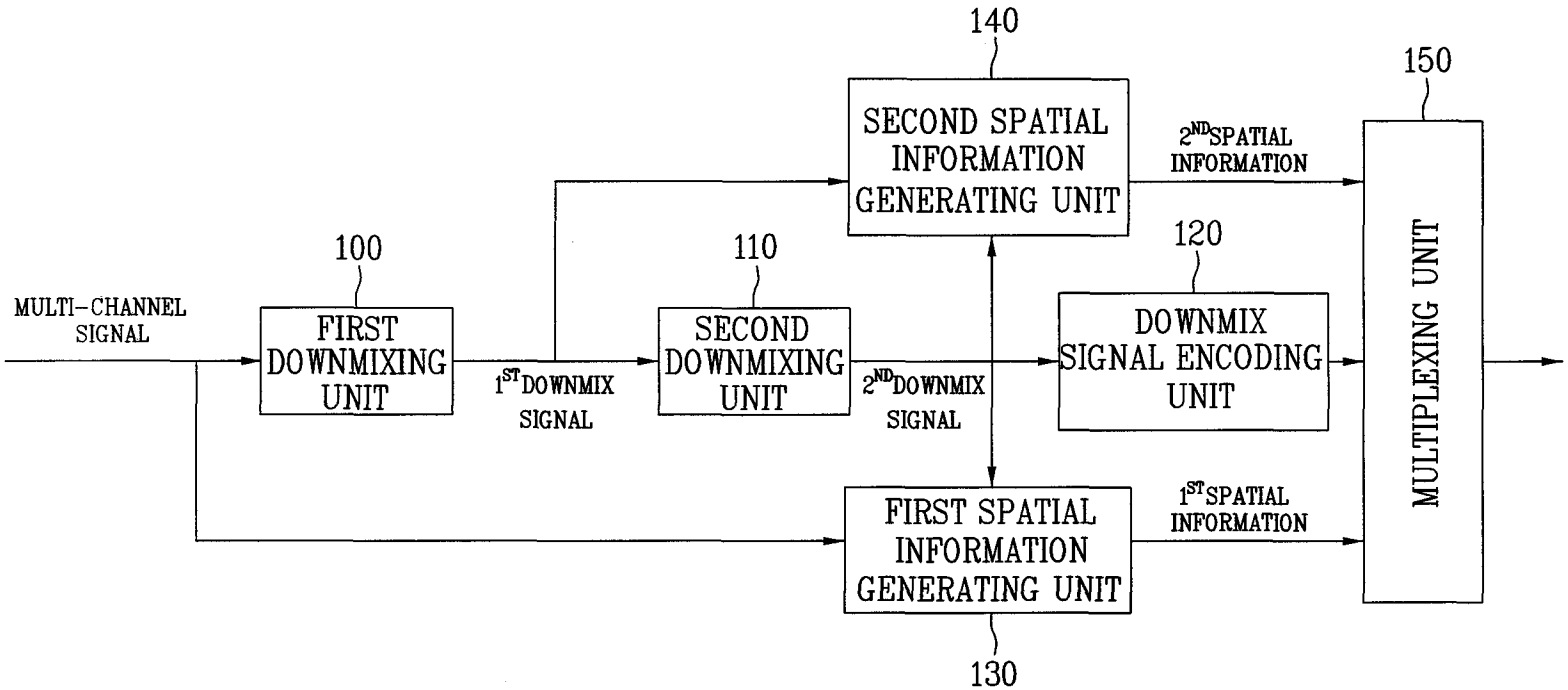
FIG. 1 is a block diagram of a first encoding apparatus according to one embodiment of the present invention.

To achieve these and other advantages and in accordance with the purpose of the present invention, as embodied and broadly described, a method of processing a media signal includes extracting a downmix signal from a bitstream, extracting at least one of first spatial information and second spatial information from the bitstream, and generating multi-channels using the extracted spatial information and the downmix signal.

To further achieve these and other advantages and in accordance with the purpose of the present invention, a method of processing a media signal includes generating a first downmix signal from multi-channels, generating a second downmix signal from the first downmix signal, generating first spatial information using the multi-channels and the first downmix signal or the multi-channels and the second downmix signal, generating second spatial information using the first downmix signal and the second downmix signal, and generating a bitstream including the first spatial information and the second spatial information.

To further achieve these and other advantages and in accordance with the purpose of the present invention, a method of processing a media signal includes generating a first downmix signal from multi-channels, generating a second downmix signal from the first downmix signal, encoding the second downmix signal, decoding the encoded second downmix signal, generating second spatial information using the first downmix signal and the decoded second downmix signal, and generating first spatial information using the multi-channels and the decoded second downmix signal.

To further achieve these and other advantages and in accordance with the purpose of the present invention, a method of processing a media signal includes generating a first downmix signal from multi-channels, generating a second downmix signal from the first downmix signal, encoding the second downmix signal, decoding the encoded second downmix signal, generating second spatial information using the first downmix signal and the decoded second downmix signal, generating a modified first downmix signal using the decoded second downmix signal and the second spatial information, and generating first spatial information using the modified first downmix signal and the multi-channels.

To further achieve these and other advantages and in accordance with the purpose of the present invention, an apparatus for processing a signal includes a downmix signal extracting unit extracting a downmix signal from a bitstream, an information extracting unit extracting at least one of second spatial information for generating two channels from the downmix signal and first spatial information for generating at least three channels from the downmix signal from the bitstream, and a channel generating unit generating either the two channels or the at least three channels using the extracted information and the downmix signal.

To further achieve these and other advantages and in accordance with the purpose of the present invention, a bitstream structure includes first spatial information extracted in the course of generating a first downmix signal including at least two channels from multi-channels and second spatial information extracted in the course of generating a second downmix signal from the first downmix signal.

To further achieve these and other advantages and in accordance with the purpose of the present invention, a storage medium including the bitstream structure.

To further achieve these and other advantages and in accordance with the purpose of the present invention, a signal processing apparatus includes a first downmixing unit generating a first downmix signal from multi-channels, a second downmixing unit generating a second downmix signal from the first downmix signal, a first spatial information generating unit generating first spatial information using the multi-channels and the first downmix signal or the multi-channels and the second downmix signal, a second spatial information generating unit generating second spatial information using the first downmix signal and the second downmix signal, and a multiplexing unit generating a bitstream including the first spatial information and the second spatial information.

To further achieve these and other advantages and in accordance with the purpose of the present invention, a signal processing apparatus includes a downmixing unit generating a downmix signal from multi-channels, an encoding unit encoding the downmix signal, a decoding unit decoding the encoded downmix signal, and a spatial information generating unit generating spatial information using the multi-channels and the decoded downmix signal.

Mode for Invention

Reference will now be made in detail to the preferred embodiments of the present invention, examples of which are illustrated in the accompanying drawings. For facilitation in understanding the present invention, an audio signal encoding method and apparatus are explained prior to an audio signal decoding method and apparatus. Yet, the decoding method and apparatus according to the present invention are not limited by an encoding method and apparatus that will be explained in the following description. And, the present invention is applied to a coding scheme for generating two channels using spatial information and a coding scheme for generating multi-channels using spatial information as well as MP3 (MPEG 1/2-layer III) and AAC (advanced audio coding).

An encoding apparatus for compressing a 2-channel signal receives the 2-channel signal, downmixes the received signal into a moo signal, and extracts spatial information indicating a relation with the 2-channel signal. An encoding apparatus for compressing a multi-channel signal downmixes the multi-channel signal into one or two audio signals and extract information indicating a relation with the multi-channel signal. An encoding apparatus is cable to generates a 2-channel signal by downmixing a multi-channel signal or generates a mono signal by downmixing the 2-channel signal again. In this case, the encoding apparatus extracts spatial information from the relation between the multi-channel signal and the 2-channel signal in downmixing the multi-channel signal into the 2-channel signal or extracts spatial information from the relation between the 2-channel signal and the mono signal in downmixing the 2-channel signal into the mono signal. An encoding apparatus is able to separately transfer spatial information for reconstructing 2-channel signal and spatial information for reconstructing multi-channel signal to a decoding apparatus. Alternatively, the encoding apparatus generates a bitstream including spatial information for reconstructing 2-channel signal and spatial information for reconstructing multi-channel signal and then transfer the bitstream to the decoding apparatus. In case that a signal the decoding apparatus is able to generate is either the 2-channel signal or the multi-channel signal, the decoding apparatus having received the bitstream including the spatial information for reconstructing the 2-channel signal and the spatial information for reconstructing the multi-channel signal extracts the spatial information for reconstruct the generatable channel signal from the bitstream only and is then able to reconstruct the channel signal using the extracted spatial information. In case that the decoding apparatus is capable of reconstruct both of the 2-channel signal and the multi-channel signal, the decoding apparatus extracts spatial information required for generating a channel signal selected by a user from the bitstream only and is then able to generate the channel signal selected by the user using the extracted spatial information.

An encoding method and apparatus for generating a bitstream including spatial information for reconstructing 2-channel signal and spatial information for reconstructing multi-channel signal are explained with reference to FIG. 1 and FIG. 2 as follows.

FIG. 1 is a block diagram of a first encoding apparatus according to one embodiment of the present invention.

Referring to FIG. 1, a first encoding apparatus includes a first downmixing unit 100, a second downmixing unit 110, a downmix signal encoding unit 120, a first spatial information generating unit 130, a second spatial information generating unit 140, and a multiplexing unit 150.

The first downmixing unit 100 receives a multi-channel signal and then downmixes the received signal. into a first downmix signal having channels less than those of the multi-channel signal. And, the second downmixing unit 110 downmixes the first downmix signal into a second downmix signal having channels less than those of the first downmix signal.

Each of the downmixing units 100 and 110 can use an OTT (one-to-two) box or a TTT (two-to-three) box to transform two channels into one channel or transform three channels into two channels. The OTT or TTT box is a conceptional box included in an audio signal decoding apparatus to be used in generating multi-channels using a downmix signal and spatial information. The OTT box transforms one signal into two signals using spatial information. The TTT box transforms two signals into three signals using spatial information. In the following description, the OTT or TTT box is called a signal transforming unit. To correspond the OTT or TTT box used for the audio signal decoding apparatus, an OTT or TTT box is included in the downmixing unit 100 or 110 of the audio signal encoding apparatus to be used in outputting one or two down mix signals from inputted multi-channels.

The first/second downmix signal can be artificially generated instead of being generated by the downmixing unit 100/110. Since the second downmix signal is a signal including channels less than those of the first downmix signal, in case that the second downmix signal is a mono signal, the first downmix signal should include at least two channels. In case that the first downmix signal is a 2-channel signal, the multi-channel signal should include at least three channels.

The downmix signal encoding unit 120 compresses the second downmix signal and then sends the compressed downmix signal to the multiplexing unit 150. The first spatial information generating unit 130 generates first spatial information using the multi-channel signal and the second downmix signal and then sends the first spatial information to the multiplexing unit 150.

Spatial information is the information indicating a relation with a channel in downmixing a channel signal. And, the spatial information is used for a decoding apparatus to reconstruct an original channel signal from a downmix signal. First spatial information generated from downmixing a multi-channel signal includes CLD (channel level differences), ICC (interchannel correlations), CPC (channel prediction coefficients), or the like. The CLD indicates an energy difference between audio signals. The ICC indicates correlation or similarity between audio signals. And, the CPC indicates a coefficient for predicting an audio signal using another signal. The second spatial information generating unit 140 generates second spatial information using the first downmix signal and the second downmix signal and then sends the second spatial information to the multiplexing unit 150. In case that the first downmix signal is a 2-channel signal, the second spatial information can include IID (interchannel intensity difference) indicating an energy difference between two channels, IPD (interchannel phase difference) indicating a phase difference between two channels, ICC (interchannel correlation) indicating correlation between two channels, and the like.

Spatial information is the information extracted in the course of downmixing a channel signal according to a predetermined tree structure. In this case, the predetermined tree structure means the tree structure agreed between a decoding apparatus and an encoding apparatus. Spatial information is able to include tree structure information. In this case, the tree structure information is the information for a type of a tree structure. According to the type of the tree structure, the number of multi-channels, a per channel downmix sequence, and the like can be changed.

The multiplexing unit 150 generates a bitstream including the first spatial information and the second spatial information and then transfers the generated bitstream to the decoding apparatus together with or separately from a downmix signal.

The encoding apparatus is able to transfer the second downmix signal in a PCM signal format to the decoding apparatus. In this case, the multiplexing unit 150 generates a bitstream including the first spatial information and the second spatial information and then transfers the generated bitstream to the decoding apparatus together with or separately from a PCM signal. In case of transferring both of the PCM signal and the spatial information to the decoding apparatus, the multiplexing unit 150 generates one bitstream by embedding the first spatial information and the second spatial information in the PCM signal and then transfers the generated bitstream to the decoding apparatus.

And, the encoding apparatus is able to insert an identifier in the bitstream, In this case, the identifier indicates whether the transferred bitstream includes the second spatial information for the 2-channel signal generation, the first spatial information for the multi-channel signal generation, or both of the first spatial information and the second spatial information.

Figure 2:
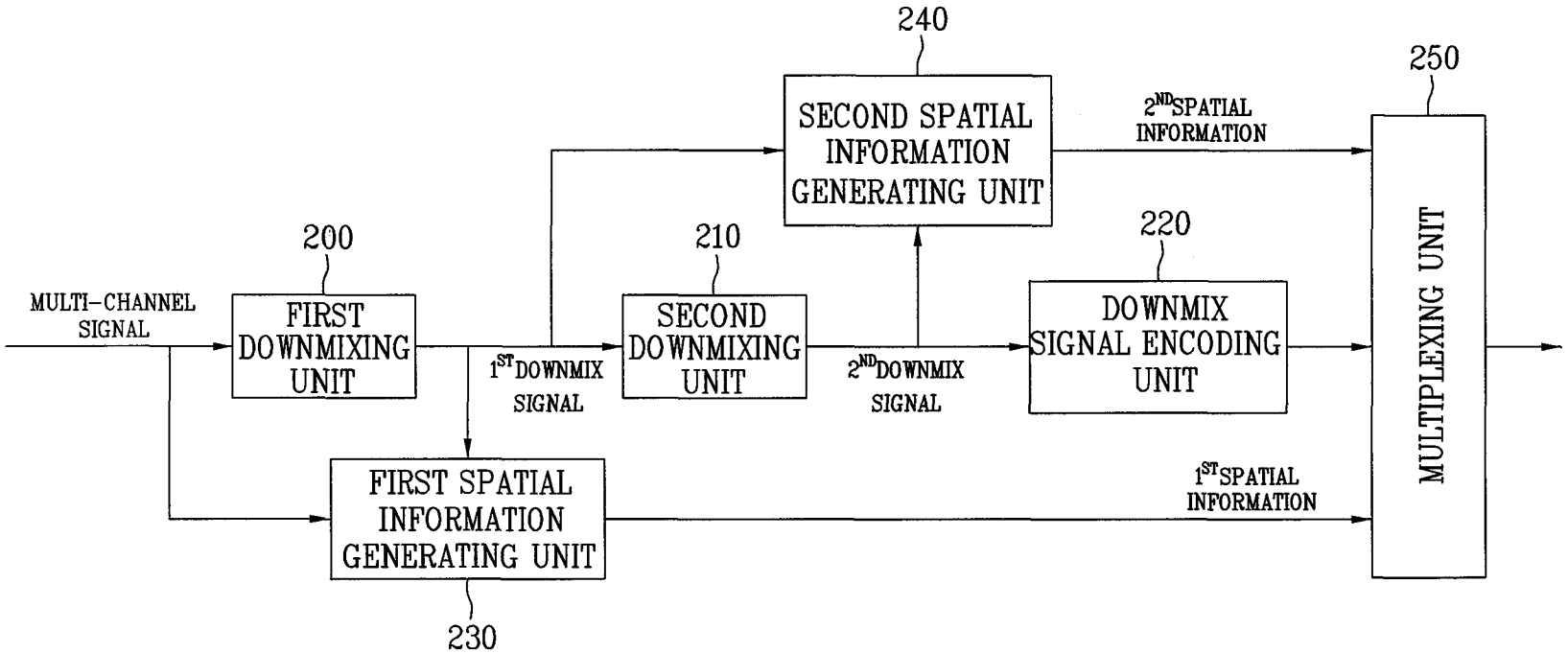
FIG. 2 is a block diagram of a second encoding apparatus according to another embodiment of the present invention.

FIG. 2 is a block diagram of a second encoding apparatus according to another embodiment of the present invention.

Referring to FIG. 2, a second encoding apparatus includes a first downmixing unit 200, a second downmixing unit 210, a downmix signal encoding unit 220, a first spatial information generating unit 230, a second spatial information generating unit 240, and a multiplexing unit 250.

The first downmixing unit 200 receives a multi-channel signal and then downmixes the received signal into a first downmix signal having channels less than those of the multi-channel signal. And, the second downmixing unit 210 downmixes the first downmix signal into a second downmix signal having channels less than those of the first downmix signal.

The downmix signal encoding unit 220 compresses the second downmix signal and then sends the compressed signal to the multiplexing unit 250. The second downmix signal can be transferred in a PCM signal format to a decoding apparatus without passing through the downmix signal encoding unit 220.

The first spatial information generating unit 230 generates first spatial information using the multi-channel signal and the first downmix signal. The second spatial information generating unit generates second spatial information using the first downmix signal and the second downmix signal. And, the first spatial information generating unit 230 and the second spatial information generating unit 240 send the first spatial information and the second spatial information to the multiplexing unit 250, respectively.

The multiplexing unit 150 generates a bitstream by multiplexing the compressed downmix signal, the first spatial information, and the second spatial information together and then transfers the generated bitstream to the decoding apparatus.

The encoding apparatus separately generates a stream of the downmix signal, a stream for the first spatial information, and a stream for the second spatial information and then respectively transfers the separate streams to the decoding apparatus. Alternatively, the encoding apparatus generates a bitstream including the first spatial information and the second spatial information and then transfers the generated bitstream to the decoding apparatus together with the downmix signal.

The second encoding apparatus differs from the first encoding apparatus, which generates the first spatial information using the multi-channel signal and the second downmix signal, in generating the first spatial information using the multi-channel signal and the first downmix signal. So, the first spatial information generated by the first encoding apparatus differs from the first spatial information generated by the second encoding apparatus.

The decoding apparatus, which has received the downmix signal and the spatial information generated by the encoding apparatus explained in FIG. 1 or FIG. 2, reconstructs the 2-channel signal or the multi-channel signal using the spatial information and the downmix signal. The decoding apparatus decodes the downmix signal encoded and transferred by the encoding apparatus and then reconstructs the 2-channel signal or the multi-channel signal using the decoded downmix signal and the spatial information. So, an audio signal reconstructed by the decoding apparatus differs from an audio signal prior to downmixing in an audio quality. To prevent this, the encoding apparatus is able to generate spatial information using the downmix signal used for the decoding apparatus to reconstruct the audio signal.

An encoding method and apparatus for generating spatial information using a downmix signal user for a decoding apparatus to reconstruct an audio signal are explained with reference to FIG. 3 and FIG. 4 as follows.

Figure 3:
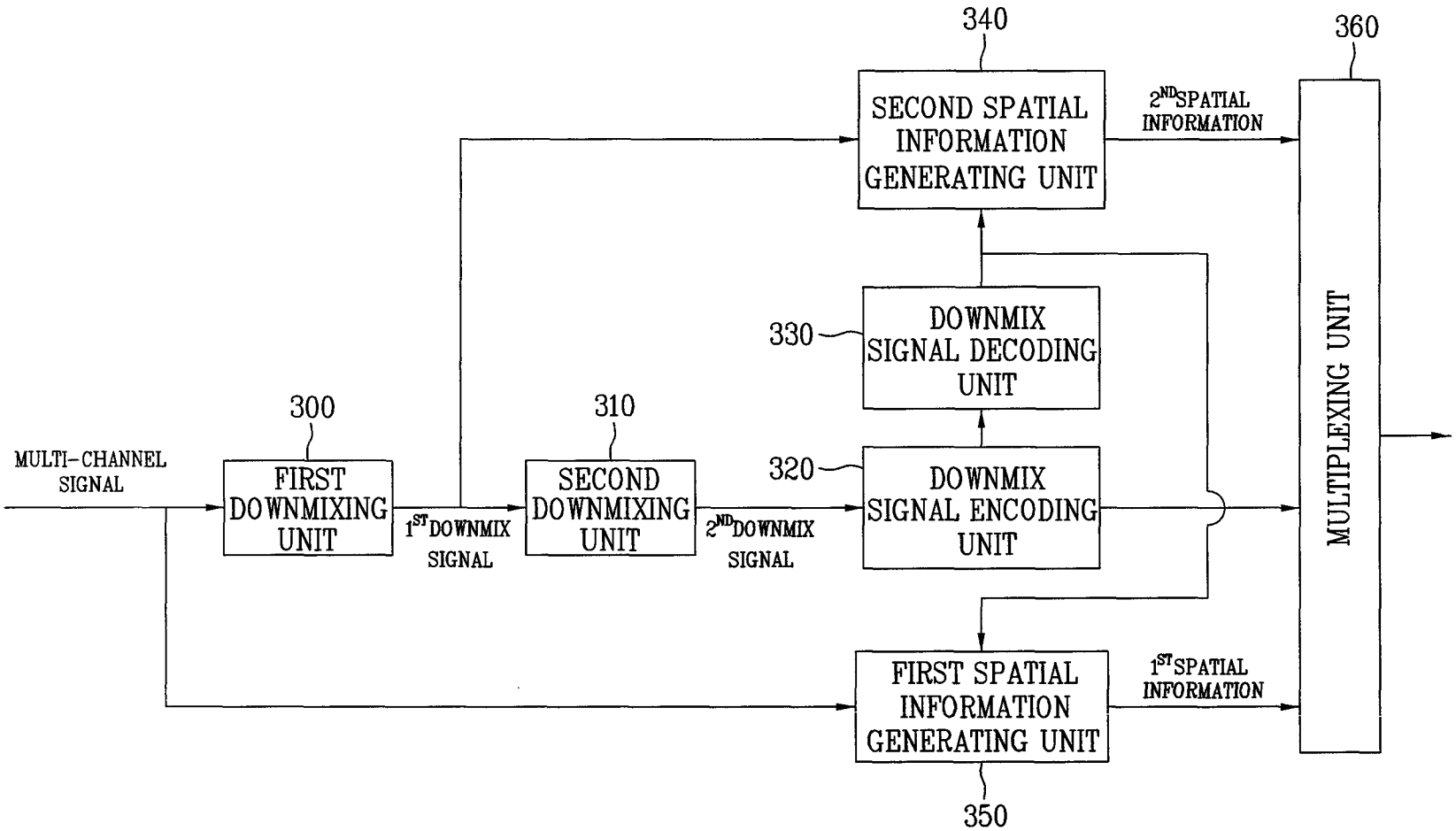
FIG. 3 is a block diagram of a third encoding apparatus for generating spatial information using a decoded downmix signal according to one embodiment of the present invention.

FIG. 3 is a block diagram of a third encoding apparatus for generating spatial information using a decoded downmix signal according to one embodiment of the present invention.

Referring to FIG. 3, a third encoding apparatus includes a first downmixing unit 300, a second downmixing unit 310, a downmix signal encoding unit 320, a downmix signal decoding unit 330, a first spatial information generating unit 350, a second spatial information generating unit 340, and a multiplexing unit 360.

The third encoding apparatus differs from the first encoding apparatus in including the downmix signal decoding unit 330.

The first downmixing unit 300 downmixes a multi-channel signal into a first downmix signal and the second downmixing unit 310 downmixes the first downmix signal into a second downmix signal. The downmix signal encoding unit 320 encodes the second downmix signal. The downmix signal decoding unit 330 decodes the encoded second downmix signal. The second spatial information generating unit 340 generates second spatial information using the first downmix signal and the decoded second downmix signal.

The first encoding apparatus has a common feature with the third encoding apparatus in that the second spatial information is generated using the relation between the first downmix signal and the second downmix signal. Yet, the third encoding apparatus differs from the first encoding apparatus, which generates the second spatial information using the second downmix signal downmixed by the second downmixing unit 110, in encoding the second downmix signal, decoding the encoded second downmix signal, and then generating the second spatial information using the decoded second downmix signal. And, the second spatial information generated by the first encoding apparatus differs from the second spatial information generated by the third encoding apparatus.

The first spatial information generating unit 350 generates first spatial information using the multi-channel signal and the decoded second downmix signal. Unlike the first encoding apparatus generates the first spatial information using the second downmix signal, the third encoding apparatus encodes the second downmix signal, decodes the encoded signal again, and then generates the second spatial information using the decoded second downmix signal. Thus, the first encoding apparatus and the third encoding apparatus differ from each other. And, the first spatial information of the first encoding apparatus differs from that of the third encoding apparatus as well.

The multiplexing unit 360 multiplexes the encoded downmix signal, the first spatial information, and the second spatial information together and then transfers the multiplexed signal to the decoding apparatus.

The decoding apparatus decodes the second downmix signal encoded and transferred by the encoding apparatus and then reconstructs the 2-channel signal or the multi-channel signal by applying at least one of the first spatial information and the second spatial information to the decoded downmix signal. So, the channel signal reconstructed by the decoding apparatus has an audio quality closer to the audio signal prior to being downmixed by the encoding apparatus.

Figure 4:
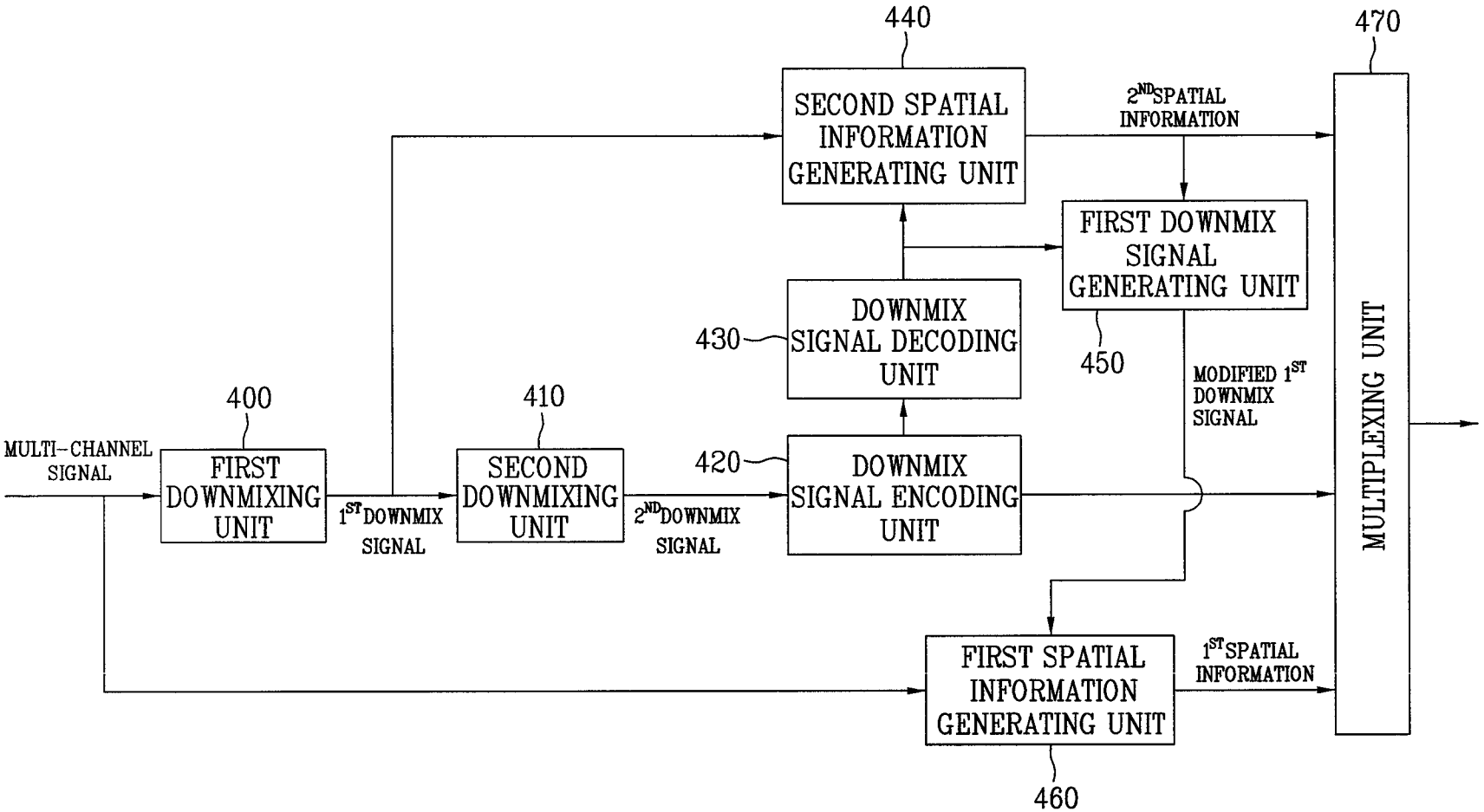
FIG. 4 is a block diagram of a fourth encoding apparatus for generating spatial information using a decoded downmix signal according to another embodiment of the present invention.

FIG. 4 is a block diagram of a fourth encoding apparatus for generating spatial information using a decoded downmix signal according to another embodiment of the present invention.

Referring to FIG. 4, a fourth encoding apparatus includes a first downmixing unit 400, a second downmixing unit 410, a downmix signal encoding unit 420, a downmix signal decoding unit 430, a first spatial information generating unit 460, a second spatial information generating unit 440, a first downmix signal generating unit 450, and a multiplexing unit 470.

The fourth encoding apparatus differs from the second encoding apparatus in including the downmix signal decoding unit 430 and the first downmix signal generating unit 450.

The first downmixing unit 400 downmixes a multi-channel signal into a first downmix signal and the second downmixing unit 410 downmixes the first downmix signal into a second downmix signal. The downmix signal encoding unit 420 encodes the second downmix signal and then sends it to the downmix signal decoding unit 430. The downmix signal decoding unit 430 decodes the encoded downmix signal and then sends it to the second spatial information generating unit 440. The second spatial information generating unit 440 generates second spatial information using the first downmix signal and the decoded second downmix signal.

The fourth encoding apparatus differs from the second encoding apparatus, which generates the second spatial information using the second downmix signal without being encoded and decoded, in generating the second spatial information using the downmix signal encoded by the downmix signal encoding unit 420 and then decoded by the downmix signal decoding unit 430 again.

The first downmix signal generating unit 450 generates a modified first downmix signal using the second downmix signal decoded by the downmix signal decoding unit 430 and the second spatial information. The modified first downmix signal differs from the first downmix signal downmixed by the first downmixing unit 400 in being generated from the encoded and re-decoded second downmix signal and the second spatial information generated using the encoded and re-decoded second downmix signal.

The first spatial information generating unit 460 generates first spatial information using the modified first downmix signal and the multi-channel signal. The first spatial information generating unit 460 differs from the second encoding apparatus, which generates the first spatial information using the first downmix signal intactly, in generating the first spatial information using the modified first downmix signal generated by the first downmix signal generating unit 450. And, the first spatial information generated by the first spatial information generating unit 460 differs from the first spatial information generated by the second encoding apparatus. The multiplexing unit 470 generates a bitstream including both of the first spatial information and the second spatial information.

And, the fourth encoding apparatus transfers the bitstream including the spatial information to the decoding apparatus together with or separately from the second downmix signal.

Figure 5:
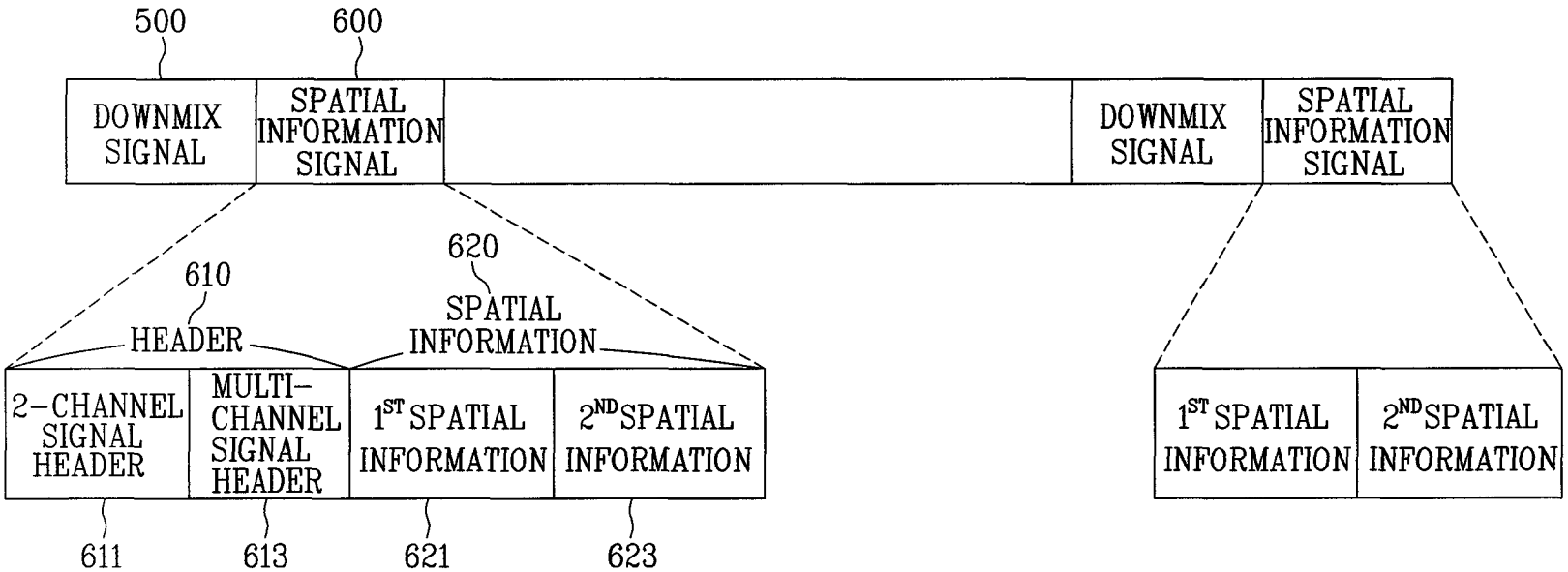
FIG. 5 is a diagram of a bitstream of an audio signal according to one embodiment of the present invention.

FIG. 5 is a diagram of a bitstream of an audio signal according to one embodiment of the present invention.

Referring to FIG. 5, an audio signal according to the present invention includes a downmix signal 500 and a spatial information signal 600. The audio signal exists in an ES elementary stream) form having frames arranged therein.

The downmix signal 500 and the spatial information signal 600 can be transferred in different ES forms to a decoding apparatus, respectively. Alternatively, they can be transferred in one ES form having the downmix and spatial information signals 500 and 600 combined together. In case of transferring the downmix signal 500 and the spatial information signal 600 in a combined form to the decoding apparatus, the spatial information signal 600 can be included in a location of ancillary data or extension data of the downmix signal 500.

The audio signal can include a codec identifier to enable a decoding apparatus to recognize basic information for audio codec without interpreting the audio signal. The codec identifier is the information indicating what kind of coding scheme is used in encoding the audio signal. The codec identifier can be included in a header 610 or spatial information 620 of the spatial information signal 600. And, the codec identifier can include a spatial information identifier. In this case, the spatial information identifier is the information indicating whether a bitstream includes second spatial information to generate 2-channel signal from the audio signal, first spatial information to generate multi-channel signal from the audio signal, or both of the first spatial information and the second spatial information. so, the decoding apparatus is able to detect a type of the audio signal generatable from the downmix signal and the like and the like using the spatial information identifier.

The spatial information signal 600 can include the header 610 and the spatial information 620. Alternatively, the spatial information signal 600 can include the spatial information 620 only without including the header 610. Namely, the spatial information signal 600 is able to use a frame including the header 610 or a frame not including the header 610 together.

In case that the audio signal includes spatial information to generate multi-channel signal and spatial information to generate 2-channel signal, the header 610 can include a 2-channel signal header 611 and a multi-channel signal header 613.

In case that a signal reconstructible by the decoding apparatus is the 2-channel signal, the decoding apparatus decodes second spatial information 623 to generate the 2-channel signal using the 2-channel signal header 611 and then reconstructs the 2-channel signal using the decoded second spatial information 623.

In case that a signal reconstructible by the decoding apparatus is the multi-channel signal, the decoding apparatus decodes spatial information to generate the multi-channel signal using the multi-channel signal header 613. The spatial information for the multi-channel signal reconstruction can include the second spatial information 623 as well as the first spatial information 621. In case that the decoding apparatus reconstructs the 2-channel signal and then reconstructs the multi-channel signal from the reconstructed 2-channel signal, the multi-channel signal can be reconstructed using the second spatial information 623 for the 2-channel signal reconstruction and the first spatial information 621 for reconstructing the multi-channel signal from the 2-channel signal step by step. And, the spatial information signal can include the aforesaid tree structure information as well.

Figure 6:
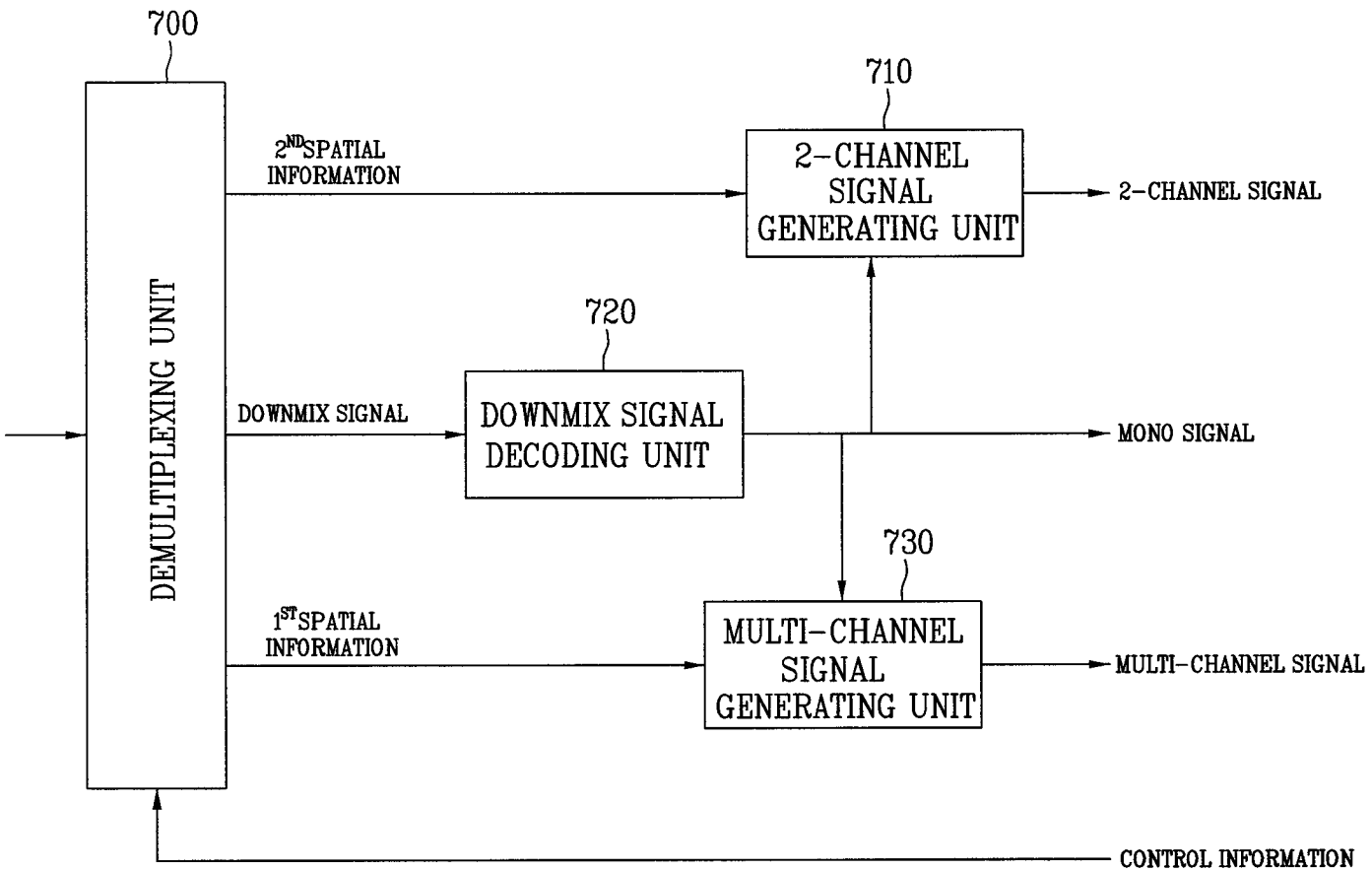
FIG. 6 is a block diagram of a first decoding apparatus according to one embodiment of the present invention.

FIG. 6 is a block diagram of a first decoding apparatus according to one embodiment of the present invention.

Referring to FIG. 6, a first decoding apparatus includes a demultiplexing unit 700, a downmix signal decoding unit 720, a 2-channel signal generating unit 710, and a multi-channel signal generating unit 730.

The demultiplexing unit 700 parses a downmix signal and then sends the parsed signal to the downmix signal decoding unit 720. The downmix signal can be a mono signal. And, the downmix signal can be a signal on a frequency domain. The frequency domain can be a QMF domain.

The downmix signal decoding unit 720 decodes the downmix signal and then outputs the decoded downmix signal intactly. The downmix signal decoding unit 720 upmixes the downmix signal into a 2-channel signal or a multi-channel signal using spatial information and then outputs the upmixed signal. In case that the downmix signal is a PCM signal, the downmix can be outputted intact without passing through the downmix signal decoding unit 720.

A decoding apparatus is able to detect what kind of spatial information is included in a bitstream using a spatial information identifier included in the bitstream.

If a downmix signal is a mono signal and if a signal generatable by the first decoding apparatus is one of a 2-channel signal and a multi-channel signal, the decoding apparatus decides whether the downmix signal is a signal capable of generating the 2-channel signal or the multi-channel signal using a spatial information identifier. If the decoding apparatus decides that both spatial information for 2-channel signal generation and spatial information for multi-channel signal generation are included in a bitstream, the decoding apparatus extracts spatial information for specific signal generation from the spatial information for 2-channel signal generation and the spatial information for multi-channel signal generation only and is then able to generate a channel signal using the extracted information.

If a downmix signal is a PCM signal, the first spatial information 621 and the second spatial information 623 can be transmitted by being embedded in the downmix signal. In this case, the demultiplexing unit 700 is able to extract the first spatial information 621 and the second spatial information 623 from the downmix signal.

In case that the decoding apparatus is capable of generating 2-channel signal only, the demultiplexing unit 700 of the decoding apparatus parses the second spatial information 623 for 2-channel signal generation in the transferred spatial information and then sends the parsed information to the 2-channel signal generating unit 710. In case that the decoding apparatus is capable of generating multi-channel signal only, the demultiplexing unit 700 of the decoding apparatus parses the first spatial information 621 for multi-channel signal generation in the transferred spatial information and then sends the parsed information to the multi-channel signal generating unit 730. Namely, if the decoding apparatus generates a multi-channel signal directly from a downmix signal and spatial information instead of generating multi-channel signal from 2-channel signal, the decoding apparatus need not use the second spatial information 623. So, the decoding apparatus extracts the first spatial information 621 only to use.

In case that the decoding apparatus is able to generate both 2-channel signal and multi-channel signal, the decoding apparatus is able to extract spatial information for user-selected channel signal generation by receiving control information from a user.

In case that a signal generatable by the decoding apparatus is 2-channel signal or a user selects 2-channel signal generation, the 2-channel signal generating unit 710 generates 2-channel signal using the second spatial information 623 parsed and sent by the demultiplexing unit 700 and the decoded downmix signal and then outputs the generated signal. The 2-channel signal generating unit 710 generates the 2-channel signal by upmixing a mono downmix signal using a signal transforming unit (not shown in the drawing), and more particularly, an OTT box. In this case, the multi-channel signal generating unit 730 needs riot to operate. The demultiplexing unit 700 can generate an identifier controlling an operation of the multi-channel signal generating unit 730 and send the generated identifier to the multi-channel signal generating unit 730. Hereinafter, the identifier controlling an operation of the 2-channel signal generating unit 710 or the multi-channel signal generating unit 730 is named an operation control identifier. The multi-channel signal generating unit 730 does not operate according to the operation control identifier received from the demultiplexing unit 700. And, it is unnecessary to consider the first spatial information 621.

In case that a signal generatable by the decoding apparatus is multi-channel signal or a user selects multi-channel signal generation, the multi-channel signal generating unit 730 generates multi-channel signal using the first spatial information 621 and then outputs the generated signal. The multi-channel signal generating unit 730 upmixes a downmix signal using a plurality of signal transforming units. As mentioned in the foregoing description, the signal transforming unit includes an OTT box or a TTT box. In this case, since the 2-channel signal generating unit 710 needs not to operate, the demultiplexing unit 700 generates an operation control identifier and then sends the generated operation control identifier to the 2-channel signal generating unit 710 to control an operation of the 2-channel signal generating unit 710. The 2-channel signal generating unit 710 does not operate according to the operation control identifier. And, it is unnecessary to consider the second spatial information 623.

The decoding apparatus can further include a modified spatial information generating unit (not shown in the drawing). The modified spatial information generating unit identifies a type of modified spatial information using spatial information and generates modified spatial information of the type identified based on the spatial information. In this case, the modified spatial information means the spatial information that is newly generated using spatial information. The modified spatial information can be generated by combining spatial information. The modified spatial information generating unit is able to generate modified spatial information using tree structure information, output channel information and the like included in the spatial information. The output channel information is the information for a speaker interconnecting with the decoding apparatus and can include the number of output channels, position information for each output channel, and the like. The output channel information is inputted to the decoding apparatus in advance by a manufacturer or can be inputted by a user.

The decoding apparatus decides whether the number of original multi-channels downmixed by the encoding apparatus is equal to the number of channels to be generated using the tree structure information and the output channel information. Hereinafter, the original multi-channels downmixed by the encoding apparatus are named first multi-channels. If the number of the first multi-channels downmixed by the encoding apparatus is different from the number of multi-channels to be generated, the decoding apparatus is able to modify spatial information using the modified spatial information generating unit. In this case, the modified spatial information can be generated by combining the aforesaid CLD, ICC, CPC, IPC, and the like. The decoding apparatus is able to generate multi-channels of which number differs from the number of the first multi-channels using the modified spatial information and the downmix signal.

Figure 7:
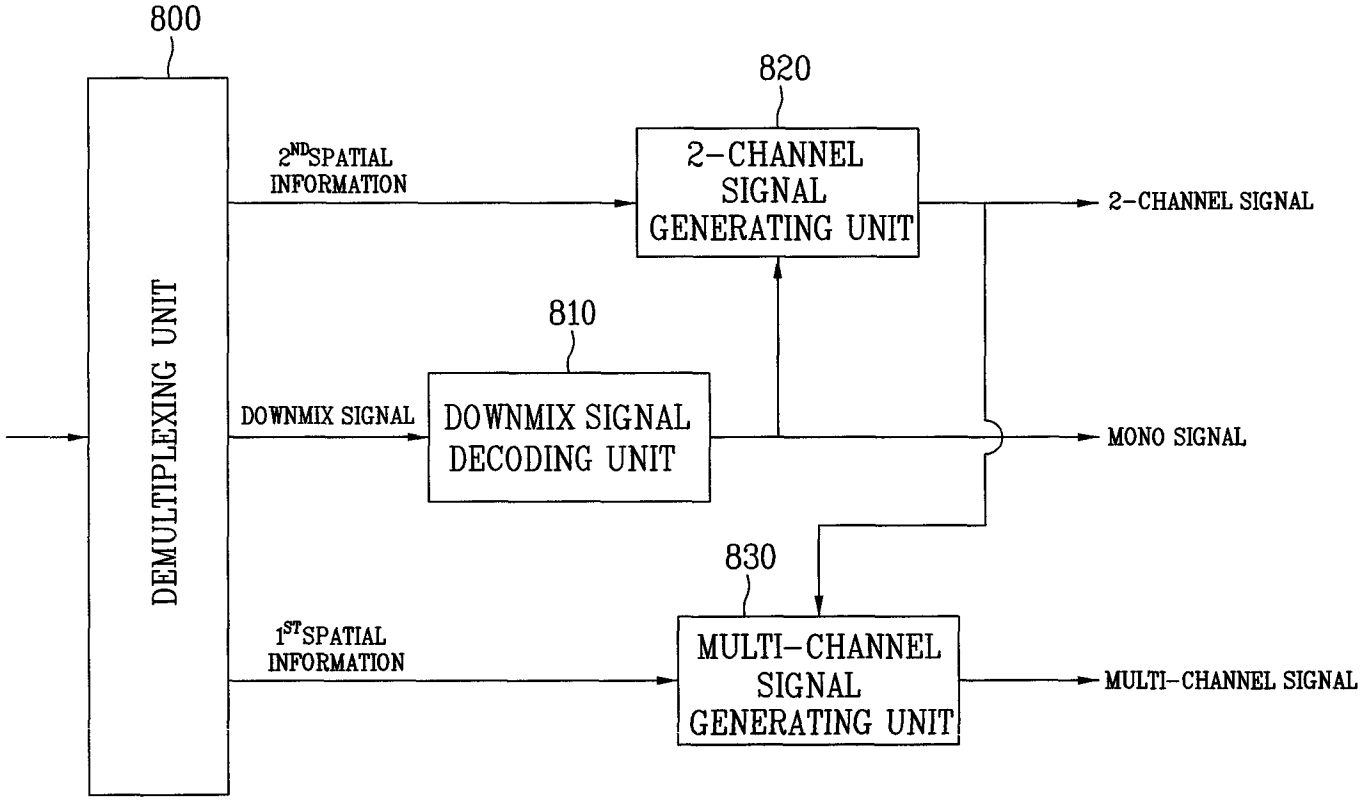
FIG. 7 is a block diagram of a second encoding apparatus according to another embodiment of the present invention.

FIG. 7 is a block diagram of a second encoding apparatus according to another embodiment of the present invention.

Referring to FIG. 7, a second decoding apparatus includes a demultiplexing unit 800, a downmix signal decoding unit 810, a 2-channel signal generating unit 820, and a multi-channel signal generating unit 830.

The demultiplexing unit 800 parses a downmix signal from a bitstream transferred from an encoding apparatus or a bitstream recorded in a storage medium and then sends the parsed signal to the downmix signal decoding unit 810.

The downmix signal decoding unit 810 decodes the downmix signal and outputs the decoded signal as a mono signal or generates 2-channel signal or multi-channel signal using spatial information.

In case that the decoding apparatus is able to generate 2-channel signal or that 2-channel signal generation is selected by a user despite that the decoding apparatus is able generate both 2-channel signal and multi-channel signal, the demultiplexing unit 800 extracts second spatial information 623 for 2-channel signal generation and then sends the extracted information to the 2-channel signal generating unit.

The 2-channel signal generating unit 820 generates 2-channel signal using the second spatial information 623 and the decoded downmix signal.

Since the second spatial information 623 is applied to the downmix signal on a frequency domain, the 2-channel signal should be converted to a signal on a time domain in order for the decoding apparatus to output the 2-channel signal. The decoding apparatus is able to use FFT (fast Fourier transform), DFT (discrete Fourier transform), QMF or hybrid function, or the like in converting a time domain to a frequency domain, and vice versa. And, the decoding apparatus output a domain-converted 2-channel signal.

In case that the decoding apparatus generates the 2-channel signal only, it is unnecessary to generate multi-channel signal. So, the demultiplexing unit 800 generates an operation control identifier in order for the multi-channel signal generating unit 830 not to operate and then sends the generated identifier to the multi-channel signal generating unit 830. The multi-channel signal generating unit 830 does not operate according to the operation control identifier. And, it is unnecessary to consider the first spatial information 621 for the multi-channel signal generation.

In case that the decoding apparatus is able to generate multi-channel signal or that multi-channel signal generation is selected by a user, the demultiplexing unit 800 extracts spatial information for the multi-channel signal generation. Since the second decoding apparatus generates multi-channel signal using 2-channel signal unlike the first decoding apparatus, the demultiplexing unit 800 extracts both second spatial information 623 for 2-channel signal generation and first spatial information 621 for generating multi-channel signal from the 2-channel signal. So, the first spatial information used by the first decoding apparatus is discriminated from the first spatial information used by the second decoding apparatus. In particular, the second spatial information used by the second decoding apparatus is the spatial information required for generating the multi-channel signal from the 2-channel signal, whereas the first spatial information used by the first decoding apparatus is the spatial information required for generating multi-channels from the downmix signal.

The 2-channel signal generating unit 820 generates 2-channel signal using the second spatial information 623 and the decoded downmix signal and then sends the generated signal to the multi-channel signal generating unit 830.

The multi-channel signal generating unit 830 is able to generate multi-channel signal using the 2-channel signal sent by the 2-channel signal generating nit 820 and the first spatial information 621 extracted by the demultiplexing unit 800. In case that the 2-channel signal generation and the multi-channel signal generation are carried out on the same domain, i.e., a frequency domain, the multi-channel signal generating unit 830 is able to generate multi-channel signal using 2-channel signal on the frequency domain. In this case, the frequency domain includes a QMF domain, a hybrid domain, or the like. In particular, the multi-channel signal generating unit 830 is able to generate multi-channel signal by applying the first spatial information 621 to the 2-channel signal having a domain not converted to a time domain. In this case, it is unnecessary to convert the 2-channel signal to a signal on the time domain. And, a user is able to select and use the 2-channel signal or the multi-channel signal using the first decoding apparatus, the second decoding apparatus, or the like.

What is claimed is:

1. A method of decoding an audio signal, comprising:

extracting a downmix signal from a bitstream by a downmix signal extracting unit, wherein the bitstream includes first spatial information and second spatial information;

extracting at least one of the first spatial information and the second spatial information from the bitstream by a spatial information extracting unit, wherein the first spatial information is information for generating a multi-channel audio signal having at least three channels and wherein the second spatial information is information for generating a stereo audio signal having two channels, wherein the first spatial information includes parameters of channel level differences (CLD), interchannel correlations (ICC), channel prediction coefficients (CPC), and wherein the second spatial information includes parameters of interchannel intensity differences (IID), interchannel phase difference (IPD) and ICC; and generating at least one of the multi-channel audio signal and the stereo audio signal using the extracted downmix signal and one of the first and second spatial information by a channel generating unit, wherein when the multi-channel audio signal is generated, the downmix signal is upmixed using the first spatial information and the second spatial information is ignored, wherein when the stereo audio signal is generated, the downmix signal is upmixed using the second spatial information and the first spatial information is ignored.

2. The method of claim 1, wherein the generating the stereo audio signal comprises upmixing the downmix signal using a signal transforming unit if the second spatial information is extracted.

3. The method of claim 1, further comprising:

modifying the first spatial information to generate modified spatial information.

4. The method of claim 3, wherein the modifying the first spatial information further includes:

combining parameters in the first spatial information.

5. The method of claim 4, wherein the generating audio signal further includes generating a second audio signal using the modified spatial information and the downmix signal, wherein the downmix signal is a signal generated from downmixing the multi-channel audio signal and wherein a channel number of the second audio signal differs from a channel number of the multi-channel audio signal.

6. The method of claim 1, wherein the downmix signal comprises a mono signal.

7. The method of claim 1, wherein the extracting the first or second spatial information and the generating the audio signal are carried out according to a user's selection or a generable channel type by an apparatus for performing the method.

8. A method of encoding an audio media signal, comprising:

generating a downmix signal by downmixing the audio signal, wherein the audio signal is at least one of a stereo audio signal and an multi-channel audio signal, by a downmixing unit;

generating first spatial information and second spatial information by a spatial information generating unit, the first spatial information for decoding the multi-channel audio signal having at least three channels using the downmix signal, and the second spatial information for decoding the stereo audio signal having two channels using the downmix signal, wherein the first spatial information includes parameters of channel level differences (CLD), interchannel correlations (ICC), channel prediction coefficients (CPC), and wherein the second spatial information includes parameters of interchannel intensity differences (IID), interchannel phase difference (IPD) and ICC; and generating a bitstream including the first spatial information and the second spatial information.

9. An apparatus for decoding an audio signal, comprising:

a downmix signal extracting unit for extracting a downmix signal from a bitstream, wherein the bitstream includes first spatial information and second spatial information;

a spatial information extracting unit for extracting at least one of the first spatial information and the second spatial information from the bitstream, wherein the first spatial information is information for generating a multi-channel audio signal having at least three channels and wherein the second spatial information is information for generating a stereo audio signal having two channels, wherein the first spatial information includes parameters of channel level differences (CLD), interchannel correlations (ICC), channel prediction coefficients (CPC), and wherein the second spatial information includes parameters of interchannel intensity differences (IID), interchannel phase difference (IPD) and ICC; an a channel generating unit for generating at least one of the multi-channel audio signal or the stereo audio signal using the downmix signal and one of the first and second spatial information, wherein when the multi-channel audio signal is generated, the downmix signal is upmixed by a processor using the first spatial information and the second spatial information is ignored, wherein when the stereo audio signal is generated, the downmix signal is upmixed by the processor using the second spatial information and the first spatial information is ignored.

10. The apparatus of claim 9, wherein the spatial information extracting unit further comprises:

a spatial information modifying unit for modifying the extracted first spatial information to generate modified spatial information.

11. The apparatus of claim 10, wherein the spatial information modifying unit combines parameters in the first spatial information for the modifying.

12. The apparatus of claim 11, wherein the channel generating unit generates a second audio signal using the modified spatial information and the downmix signal, wherein the downmix signal is a signal generated from downmixing the multi-channel audio signal and wherein a channel number of the second audio signal differs from a number of the multi-channel audio signal.

13. An apparatus of encoding an audio signal, comprising:

a downmixing unit for generating a downmix signal by downmixing the audio signal, wherein the audio signal is at least one of stereo audio signal and multi-channel audio signal;

a first spatial information generating unit for generating first spatial information for decoding the multi-channel audio signal having at least three multi-channels using the downmix signal;

a second spatial information generating unit for generating second spatial information for decoding the stereo audio signal having two channels using the downmix signal, wherein the first spatial information includes parameters of channel level differences (CLD), interchannel correlations (ICC), channel prediction coefficients (CPC), and wherein the second spatial information includes parameters of interchannel intensity differences (IID), interchannel phase difference (IPD) and ICC; and a multiplexing unit for generating, by a processor, a bitstream including the first spatial information and the second spatial information.

* * * * *

UNITED STATES PATENT AND TRADEMARK OFFICE

CERTIFICATE OF CORRECTION

PATENT NO. : 8,626,515 B2
APPLICATION NO. : 12/295451
DATED : January 7, 2014
INVENTOR(S) : Oh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1357 days.

Signed and Sealed this
Fifth Day of May, 2015

Michelle K. Lee

Michelle K. Lee
*Director of the United States Patent and Trademark Office*